US010991492B2

(12) United States Patent
Fujiwara et al.

(10) Patent No.: US 10,991,492 B2
(45) Date of Patent: Apr. 27, 2021

(54) R-T-B BASED PERMANENT MAGNET

(71) Applicant: TDK CORPORATION, Tokyo (JP)

(72) Inventors: Mariko Fujiwara, Tokyo (JP); Makoto Iwasaki, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 16/823,487

(22) Filed: Mar. 19, 2020

(65) Prior Publication Data

US 2020/0303098 A1 Sep. 24, 2020

(30) Foreign Application Priority Data

Mar. 20, 2019 (JP) ..... JP2019-053644

(51) Int. Cl.

| | |
|---|---|
| ***C22C 38/16*** | (2006.01) |
| ***C22C 38/14*** | (2006.01) |
| ***C22C 38/10*** | (2006.01) |
| ***C22C 38/00*** | (2006.01) |
| ***C22C 38/06*** | (2006.01) |
| ***H01F 1/057*** | (2006.01) |
| ***B22F 3/24*** | (2006.01) |

(52) U.S. Cl.

CPC ..... *H01F 1/057* (2013.01); *B22F 3/24* (2013.01); *C22C 38/002* (2013.01); *C22C 38/005* (2013.01); *C22C 38/06* (2013.01); *C22C 38/10* (2013.01); *C22C 38/14* (2013.01); *C22C 38/16* (2013.01); *B22F 2003/248* (2013.01)

(58) Field of Classification Search

CPC ..... C22C 38/002; C22C 38/005; C22C 38/06; C22C 38/10; C22C 38/14; C22C 38/16

USPC ..... 420/83

See application file for complete search history.

(56) References Cited

U.S. PATENT DOCUMENTS

| | | | | |
|---|---|---|---|---|
| 2014/0341774 | A1* | 11/2014 | Okuda | B82Y 30/00 420/83 |
| 2018/0040400 | A1* | 2/2018 | Takeda | H01F 1/0577 |
| 2018/0082772 | A1 | 3/2018 | Okawa et al. | |
| 2018/0108463 | A1 | 4/2018 | Okawa et al. | |
| 2018/0114616 | A1 | 4/2018 | Okawa et al. | |

FOREIGN PATENT DOCUMENTS

| | | | |
|---|---|---|---|
| WO | 2016/153057 | A1 | 9/2016 |

* cited by examiner

*Primary Examiner* — Humera N. Sheikh
*Assistant Examiner* — Katherine A Christy
(74) *Attorney, Agent, or Firm* — Oliff PLC

(57) ABSTRACT

The present invention provides an R-T-B based permanent magnet capable of improving a coercive force HcJ while maintaining a residual magnetic flux density Br.

The R-T-B based permanent magnet includes Ga. R is one or more selected from rare earth elements, T is Fe or a combination of Fe and Co, and B is boron. The R-T-B based permanent magnet has main phase grains including a crystal grain having an $R_2T_{14}B$ crystal structure and grain boundaries formed between adjacent two or more main phase grains, and $0.030 \leq [Ga]/[R] \leq 0.100$ is satisfied in which [Ga] represents an atomic concentration of Ga and [R] represents an atomic concentration of R in the main phase grains.

9 Claims, 1 Drawing Sheet

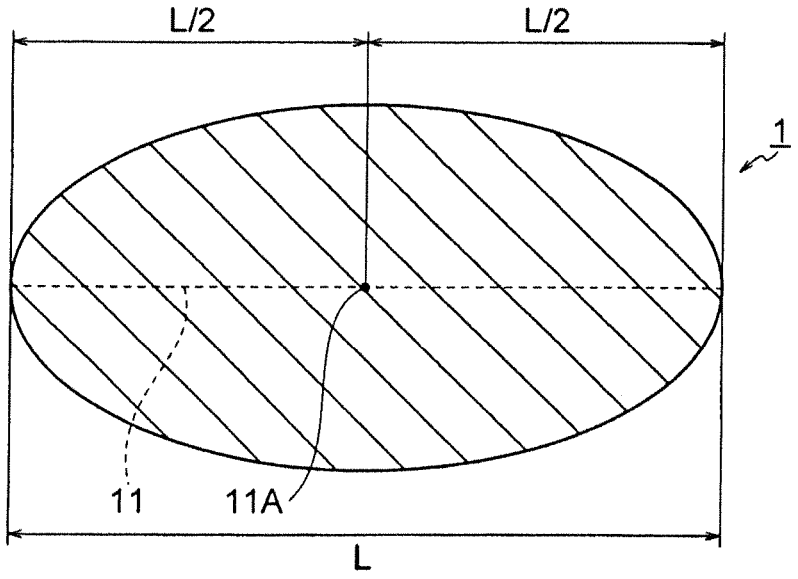
L/2
L/2
1
11
11A
L

R-T-B BASED PERMANENT MAGNET

TECHNICAL FIELD

The present invention relates to an R-T-B based permanent magnet.

BACKGROUND

Patent Document 1 discloses a rare earth magnet including a crystal grain having an $R_2T_{14}B$ crystal structure as a main phase, and having Ga concentration gradient which increases towards inside of the main phase grain from surface of the main phase grain. Patent Document 1 discloses the rare earth permanent magnet having improved demagnetization factor at high temperature and coercive force at room temperature.

[Patent Document 1] WO 2016/153057

SUMMARY

Currently, an R-T-B based permanent magnet having further improved coercive force at room temperature is demanded.

The object of the present invention is to provide the R-T-B based permanent magnet having an improved coercive force HcJ at room temperature while maintaining a residual magnetic flux density Br.

In order to attain the above object, the R-T-B based permanent magnet according to the present invention includes Ga, wherein R is one or more rare earth elements, T is Fe or a combination of Fe and Co, and B is boron, the R-T-B based permanent magnet has main phase grains including a crystal grain having an $R_2T_{14}B$ crystal structure and grain boundaries formed between adjacent two or more main phase grains, and $0.030 \leq [Ga]/[R] \leq 0.100$ is satisfied in which [Ga] represents an atomic concentration of Ga and [R] represents an atomic concentration of R in the main phase grains.

The R-T-B based permanent magnet according to the present invention can particularly improve HcJ at room temperature without decreasing Br by having the above-mentioned characteristics.

The grain boundaries may include an $R_6T_{13}Ga$ phase.

BRIEF DESCRIPTION OF THE DRAWINGS

FIGURE is a schematic diagram showing a method of determining an approximate center part.

DETAILED DESCRIPTION

Hereinafter, the present invention is described based on an embodiment.

<R-T-B Based Permanent Magnet>

The R-T-B based permanent magnet according to the present embodiment is described. The R-T-B based permanent magnet according to the present embodiment has main phase grains including a crystal grain having an $R_2T_{14}B$ crystal structure and grain boundaries formed between adjacent two or more main phase grains.

An average grain size of the main phase grains is usually 1 μm to 30 μm or so.

The R-T-B based permanent magnet according to the present embodiment may be a sintered body formed using an R-T-B based alloy.

R represents at least one selected from rare earth elements. The rare earth elements includes Sc, Y, and lanthanoids which belong to a third group of a long-periodic table. Lanthanoids include La, Ce, Pr, Nd, Sm, Eu, Gd, Tb, Dy, Ho, Er, Tm, Yb, Lu, and the like. The rare earth elements are classified into light rare earth elements and heavy rare earth elements. The heavy rare earth elements refer to Gd, Tb, Dy, Ho, Er, Tm, Yb, and Lu; and the light rare earth elements are other rare earth elements beside the heavy rare earth elements. In the present embodiment, from the point of suitably regulating a production cost and magnetic properties, Nd and/or Pr may be included as R. Also, particularly from the point of improving HcJ, the light rare earth elements and the heavy rare earth elements may be both included. A content of the heavy rare earth elements are not particularly limited, and the heavy rare earth elements may not be included. The content of the heavy rare earth elements is for example 5 mass % or less (includes 0 mass %).

In the present embodiment, T is Fe or a combination of Fe and Co. Also, B is boron.

The R-T-B based permanent magnet according to the present embodiment includes Ga in the main phase grains. Further, $0.030 \leq [Ga]/[R] \leq 0.100$ is satisfied in which [Ga] represents an atomic concentration of Ga and [R] represents an atomic concentration of [R] in the main phase grains.

As the R-T-B based permanent magnet has the main phase grains satisfying $0.030 \leq [Ga]/[R] \leq 0.100$, HcJ can be improved, particularly HcJ at room temperature can be improved. The mechanism of the improvement of HcJ is not clear. However, the present inventors speculate that HcJ is improved because a magnetic anisotropy of the main phase grains is improved. The magnetic anisotropy is improved because part of R included in the crystal grains having the $R_2T_{14}B$ type crystal structure is substituted to Ga.

To improve HcJ of the R-T-B based permanent magnet, it is not necessary that all of the main phase grains included in the R-T-B based permanent magnet satisfies $0.030 \leq [Ga]/[R] \leq 0.100$. When 70% or more of the main phase grains in number base satisfy $0.030 \leq [Ga]/[R] \leq 0.100$, HcJ of the R-T-B based permanent magnet is improved. When [Ga]/[R] of the main phase grains is too small, the magnetic properties, particularly HcJ, tend to easily decrease. It is difficult to produce an R-T-B based permanent magnet including many main phase grains having [Ga]/[R] larger than 0.100.

Note that, for example, [Ga]/[R] of the main phase grains is measured by a following method. First, the R-T-B based permanent magnet is cut at an arbitrary face and polished. Then, an element distribution at a polished cross section surface is analyzed using SEM and EDS. The magnification during measurement is 2500× to 5000×. Then, at least three main phase grains having long diameter of 4 μm or longer are selected from the obtained SEM image. Then, using EDS, electron beam of 2 μm spot diameter is irradiated to a measurement point which is set to an approximate center part of the main phase grains, thereby a content of each element is measured. Note that, it is made sure that the spot does not include the grain boundaries. [Ga]/[R] of each measurement point is calculated from a concentration of each element at each measurement point, thereby [Ga]/[R] of the main phase grains including the measurement point is obtained.

A method of determining the approximate center part is described using the FIGURE. First, when two tangent lines parallel to each other are drawn to a main phase grain 1 as shown in the FIGURE, a long diameter 11 of the main phase grain 1 is a diameter obtained by connecting two contact points having a longest distance between two tangent lines.

In the FIGURE, L represents the length of the long diameter 11. Further, a middle point of the long diameter 11 is a center 11A of the main phase grain 1. The approximate center part of the main phase grain 1 is an area near the center 11A of the main phase grain 1, specifically it is an area of which the distance from the center 11A of the main phase grain 1 is 1 μm or less.

Note that, Ga concentration in a main phase grain may specifically be 0.5 atom % or more. HcJ, particularly HcJ at room temperature, can be improved.

From the point of improving HcJ, particularly HcJ at room temperature, Ga concentration may differ within a main phase grain, and the approximate center part of the main phase grain may have a relatively high Ga concentration and an outer peripheral part of the main phase grain may have a relatively low Ga concentration.

From the point of improving HcJ, particularly HcJ at room temperature, B concentration may differ within a main phase grain, and the approximate center part of the main phase grain may have a relatively high B concentration and an outer peripheral part of the main phase grain may have a relatively low B concentration.

From the point of improving HcJ, particularly HcJ at room temperature, C concentration may differ within a main phase grain, and the approximate center part of the main phase grain may have a relatively high C concentration and an outer peripheral part of the main phase grain may have a relatively low C concentration.

The R-T-B based permanent magnet according to the present embodiment may include the $R_6T_{13}Ga$ phase in the grain boundaries. The $R_6T_{13}Ga$ phase has concentrations of R and Ga higher than in the main phase, and has a $La_6Co_{11}Ga_3$ type crystal structure. By having the $R_6T_{13}Ga$ phase in the grain boundaries, HcJ, particularly HcJ at room temperature, tends to easily improve.

The grain boundaries of the R-T-B based permanent magnet according to the present embodiment may include an R-rich phase having a higher concentration of R than in an $R_2T_{14}B$ crystal grain.

A total R content of the R-T-B based permanent magnet according to the present embodiment is not particularly limited. For example, it may be 29.0 mass % or more and 33.5 mass % or less. As the total R content decreases, HcJ tends to easily decrease. As the total R content increases, Br tends to easily decrease. In case the total R content is too small, the main phase grains of the R-T-B based permanent magnet are not formed enough. Further, α-Fe and the like having a soft magnetic property tend to easily form and HcJ tends to easily decrease. Also, in case the total R content is too much, a volume ratio of the main phase grains of the R-T-B based permanent magnet tends to easily decrease and Br tends to easily decrease.

B content of the R-T-B based permanent magnet according to the present embodiment is not particularly limited. For example, it may be 0.70 mass % or more and 0.99 mass % or less. It may be 0.80 mass % or more and 0.96 mass % or less. As B content decreases, a sintering becomes difficult to progress, a sintering temperature range having a high squareness ratio (Hk/HcJ) without occurring abnormal grain growth tends to easily become narrower. In case B content is too much, Br tends to easily decrease. Also, in case B content is larger than 0.96 mass %, it becomes difficult to form the $R_6T_{13}Ga$ phase, and non-magnetic grain boundary phases become difficult to form between the main phase grains. Therefore, HcJ at room temperature tends to easily decrease.

T is Fe or a combination of Fe and Co. T may be Fe only, or may be a combination of Fe and Co. Co content of the R-T-B based permanent magnet according to the present embodiment is not particularly limited. For example, it is 0.10 mass % or more and 2.5 mass % or less. It may be 0.10 mass % or more and 0.44 mass % or less. When Co content is less than 0.10 mass %, the corrosion resistance tends to easily decrease. As Co content increases, Br and HcJ tend to easily decrease. Also, the R-T-B based permanent magnet according to the present embodiment tends to cost more.

The R-T-B based permanent magnet according to the present embodiment further includes Ga.

Ga content of the R-T-B based permanent magnet according to the present embodiment is not particularly limited. For example, it is 0.30 mass % or more and 2.0 mass % or less. It may be 0.50 mass % or more and 1.0 mass % or less. As Ga content decreases, Ga content in the main phase grains decreases and an atomic concentration of Ga in the main phase grains decreases. Further, it becomes difficult to form the $R_6T_{13}Ga$ phase in the grain boundaries. As a result, the magnetic properties, particularly HcJ, tend to easily decrease. Also, as Ga content increases, Br tends to easily decrease.

The R-T-B based permanent magnet according to the present embodiment may further include one or more selected from Cu, Zr, and Al.

Cu content of the R-T-B based permanent magnet according to the present embodiment is not particularly limited. It may be 0.10 mass % or more and 1.5 mass % or less. It may be 0.53 mass % or more and 0.97 mass % or less. As Cu content decreases, the corrosion resistance tends to easily decrease. As Cu content increases, Br tends to easily decrease.

Al content of the R-T-B based permanent magnet according to the present embodiment is not particularly limited. For example, Al content may be 0.010 mass % or more and 0.80 mass % or less. It may be 0.10 mass % or more and 0.50 mass % or less. In some cases, it may be difficult to decrease Al content because, for example, Al tends to be easily mixed in during alloy casting. As Al content increases, Br tends to easily decrease.

Zr content of the R-T-B based permanent magnet according to the present embodiment is not particularly limited. For example, Zr content is 0.10 mass % or more and 0.80 mass % or less. It may be 0.20 mass % or more and 0.60 mass % or less. As Zr content decreases, the corrosion resistance and a sintering property tend to easily decrease. As Zr content increases, Br tends to easily decrease.

The R-T-B based permanent magnet according to the present embodiment may include O, C, and/or N.

Oxygen amount of the R-T-B based permanent magnet according to the present embodiment is not particularly limited. For example, it may be 0.300 mass % or less. It may be 0.200 mass % or less. As the oxygen amount increases, HcJ tends to easily decrease.

Carbon amount of the R-T-B based permanent magnet according to the present embodiment is not particularly limited. For example, it may be 0.003 mass % or more and 0.200 mass % or less. It may be 0.065 mass % or more and 0.120 mass % or less. As the carbon amount decreases, Fe-rich phase tends to be easily formed in the grain boundaries, and Br tends to easily decrease. As the carbon amount increases, HcJ tends to easily decrease.

Nitrogen amount of the R-T-B based permanent magnet according to the present embodiment is not particularly limited. For example, it may be 0.300 mass % or less. It may be 0.100 mass % or less. As the nitrogen amount increases, HcJ tends to easily decrease.

The oxygen amount, carbon amount, and nitrogen amount in the R-T-B based permanent magnet can be measured by methods generally known. For example, the oxygen amount is measured by an inert gas fusion-nondispersive infrared absorption method; the carbon amount is measured by a combustion in oxygen stream-infrared absorption method; and the nitrogen amount is measured by an inert gas fusion-thermal conductivity method.

Fe content of the R-T-B based permanent magnet according to the present embodiment is substantially a balance of constituting elements of the R-T-B based permanent magnet. By referring that "Fe content is substantially a balance", specifically it means that a total content other than the above-mentioned elements R, T, B, Ga, Cu, Al, Zr, O, C, and N is 1 mass % or less.

The R-T-B based permanent magnet according to the present embodiment is generally processed into an arbitrary shape and it is used. The shape of the R-T-B based permanent magnet according to the present embodiment is not particularly limited, and for example, a columnar shape such as a rectangular parallelepiped shape, a hexahedron shape, a tabular shape, a square pole shape, and the like; a cylinder shape of which a cross section shape of the R-T-B based permanent magnet is C-shaped, and the like may be mentioned. As the square pole, for example, a bottom surface of the square pole may be rectangle or square.

Also, the R-T-B based permanent magnet according to the present embodiment includes both a magnet product which has been processed and magnetized, and a magnet product which has not been magnetized.

<Method of Producing R-T-B Based Permanent Magnet>

Next, an example of a method of producing the R-T-B based permanent magnet according to the present embodiment is described. The R-T-B based permanent magnet according to the present embodiment can be produced by a usual powder metallurgy process. The powder metallurgy process includes a preparation step preparing a raw material alloy, a pulverization step of pulverizing the raw material alloy into a raw material fine powder, a compacting step forming a green compact by compacting the raw material fine powder, a sintering step sintering the green compact and obtaining a sintered body, and a heat treatment step carrying out an aging treatment to the sintered body.

The preparation step is a step of preparing the raw material alloy containing each element included in the R-T-B based permanent magnet according to the present embodiment. First, a target magnet composition is determined. Then, raw material metals and the like are prepared based on the target magnet composition. The raw material metals and the like are melted in a crucible and poured on a copper roll for solidification (a strip casting method). Thereby, the raw material alloy can be prepared. As the raw material metals, for example, rare earth metals or alloy of rare earth metals, iron, ferro-boron, carbon, and alloy of these can be used. The raw material alloy capable of obtaining the R-T-B based permanent magnet having the desired composition is prepared using these raw material metals and the like.

As an example of a preparation method of the raw material alloy, a strip casting method is described. In the strip casting method, the raw material metals and the like are melted and form a molten metal, and the molten metal is poured into a tundish. Then, the molten metal is tapped from the tundish on to a rotating copper roll, and the molten metal is cooled and solidified on the copper roll. Inside of the copper roll is cooled by water. When a temperature change of the molten metal is observed using a radiation thermometer, the molten metal at 1300° C. to 1600° C. is tapped from the tundish and rapidly cooled to the temperature range of 800° C. to 1000° C. and solidifies on the copper roll. Then, a solidified molten metal is released from the copper roll and forms alloy pieces, then they are collected in a collecting box.

Then, the alloy pieces are further cooled in the collecting box. Here, by having a cooling system in the collecting box, a cooling rate of the alloy pieces can be accelerated. As the cooling system, cooling plates aligned in a comb shape in the collecting box may be mentioned. Hereinafter, cooling performed on the copper roll may be referred as a first cooling, and cooling performed in the collecting box may be referred as a second cooling. Also, a speed at the first cooling is referred as a first cooling rate, and a speed at the second cooling is referred as a second cooling rate.

Here, by accelerating the second cooling rate, more Ga can be solid dissolved in the main phase grains, and a higher [Ga]/[R] can be attained. As an effective method to accelerate the second cooling rate, for example a method of thinning the alloy thickness may be mentioned. Also, in case the cooling plates are aligned in a comb shape in the collecting box, a method of decreasing a temperature of a coolant which cools the cooling plates, a method of increasing an amount of coolant, a method of narrowing the space between the cooling plates, and the like may be mentioned. Also, when the second cooling rate is not sufficient, less Ga can be solid dissolved in the main phase grains, and instead, the grain boundaries which have high concentration of Ga, for example the R-rich phase and the $R_6T_{13}Ga$ phase tend to be easily formed.

It is difficult to increase Ga concentration of the main phase grains simply by increasing Ga content in the molten metal. This is because Ga tends to concentrate in the grain boundaries particularly in the R-rich phase in the grain boundaries than in the main phase grains. Also, particularly in case R content of the R-T-B based permanent magnet is high and B content of the R-T-B based permanent magnet is low, many R-rich phases are formed during casting, hence it is difficult to increase Ga concentration in the main phase grains even when Ga content of the R-T-B based permanent magnet is increased. Thus, as mentioned in above, by accelerating the cooling rate at the temperature range which solidifies phases included in the grain boundaries, such as the R-rich phase when casting an alloy, the grain boundaries which have high concentration of Ga are restricted from forming, and Ga concentration in the main phase grains can be increased.

Particularly, when the cooling rate in the temperature range of 900° C. or lower is accelerated, Ga tends to easily solid dissolve in the main phase grains. Each phase included in the grain boundaries, such as the R-rich phase, solidifies at 900° C. or lower, thus when the temperature of alloy pieces is 900° C. or less, phases in the grain boundaries are formed. Therefore, the grain boundaries which have high concentration of Ga can be restricted from forming by shortening the length of time that the temperature of alloy pieces is 900° C. or less. That is, among the first cooling rate and the second cooling rate, it is particularly important to accelerate the second cooling rate in order to solid dissolve more Ga in the main phase grains.

The carbon amount included in the raw material alloy may be 0.01 mass % or more. In this case, it is easy to regulate Ga concentration and C concentration at the outer peripheral part of the main phase grain to be lower than Ga concentration and C concentration at the inner side of the main phase grain. Also, it is easy to regulate B concentration at the outer peripheral part of the main phase grain to be higher than B concentration at the inner side of the main phase grain.

As a method of regulating the carbon amount in the raw material alloy, for example a method of regulating by using raw material metals and the like including carbon may be mentioned. Particularly, a method of regulating the carbon amount by changing the type of Fe raw material is easy. In order to increase the carbon amount, carbon steel, cast iron, and the like may be used, and in order to decrease the carbon amount, electrolytic iron and the like may be used.

The pulverization step is a step of obtaining a raw material fine powder by pulverizing the raw material alloy obtained in the preparation step. This step is preferably carried out in two-steps, that is a coarse pulverization step and a fine pulverization step, but it may be done in one-step.

For example, the coarse pulverization step can be carried out using a stamp mill, a jaw crusher, a brown mill, and the like under inert gas atmosphere. A hydrogen storage pulverization can be carried out in which pulverization is carried out after hydrogen is stored into the raw material alloy. The coarse pulverization is carried out until the particle size of the raw material alloy is several hundred m to several mm or so.

The fine pulverization step is a step of preparing a raw material fine powder having an average particle size of several m or so by finely pulverizing the coarsely pulverized powder (in case of omitting the coarse pulverization step, it is raw material alloy) obtained in the coarse pulverization step. The average particle size of the raw material fine powder may be determined considering the grain size of the crystal grains after sintering. The fine pulverization can be carried out for example by using a jet mill.

A pulverization aid can be added before the fine pulverization. By adding the pulverization aid, the efficiency of pulverization step is improved, and a magnetic field orientation during the compacting step is easily done. In addition, the carbon amount while sintering can be changed and Ga concentration, C concentration, and B concentration in the main phase grains can be easily regulated suitably.

Due to the above reason, the pulverization aid may be organic materials having lubricity. Particularly, it may be organic materials including nitrogen. Specifically, metal salts of long-chain hydrocarbon acids such as stearic acid, oleic acid, lauric acid, and the like; or amide of the long-chain hydrocarbon acids may be mentioned.

From the point of regulating the C concentration of the main phase grains, the added amount of the pulverization aid may be 0.05 to 0.15 mass % with respect to 100 mass % of the raw material alloy. Also, by making a mass ratio of the pulverization aid to 5 to 15 times more of the carbon included in the raw material alloy, it is easier to regulate Ga concentration and C concentration at the outer peripheral part of the main phase grain lower than Ga concentration and C concentration at the inner side of the main phase grain. Also, it is easier to regulate B concentration of the outer peripheral part of the main phase grain to be higher than B concentration at the inner side of the main phase grain.

The compacting step is a step of compacting the raw material fine powder in the magnetic field to produce a green compact. Specifically, the raw material fine powder is filled in a mold held between electromagnets, and then while applying a magnetic field using the electromagnets to orient a crystal axis of the raw material fine powder, the raw material fine powder is pressurized to obtain a green compact. This compacting in the magnetic field may be carried out, for example, by applying a magnetic field of 1000 kA/m to 1600 kA/m, and applying 30 MPa or more and 300 MPa or less or so of pressure.

The sintering step is a step of sintering the green compact to obtain the sintered body. After compacting in the magnetic field, the green compact is sintered in a vacuum or inert gas atmosphere, thereby the sintered body can be obtained. Sintering conditions can be determined appropriately depending on conditions such as the composition of the green compact, the pulverization method of the raw material fine powder, the particle size, and the like. Here, in order to maintain Ga concentration in the main phase grains high, a sintering temperature may be a relatively low temperature such as 950° C. to 1050° C., and a sintering time may be 1 to 12 hours. The sintering temperature may be 950° C. to 1000° C. By sintering at the relatively low temperature as such, the amount of the main phase dissolving during sintering can be decreased, and Ga which solid dissolved to the main phase grains during the preparation step can be restricted from diffusing to the grain boundaries. Also, by regulating a temperature increasing process, the carbon amount in the sintered body of the R-T-B based permanent magnet can be regulated. It is preferable to set a temperature increasing rate to 1° C./min between the temperature range of room temperature and 300° C. in order to retain carbon in the green compact until it reaches sintering temperature. Also, it may be 4° C./min or faster.

The heat treatment step is a step of carrying out the aging treatment to the sintered body. By carrying out the heat treatment step, the $R_6T_{13}Ga$ phase can be formed in the grain boundaries. The $R_6T_{13}Ga$ phase is a phase formed by the part of main phase which have dissolved during the heat treatment step. Also, the $R_6T_{13}Ga$ phase is formed in the grain boundaries at a temperature of 500° C. or so. Therefore, when the $R_6T_{13}Ga$ phase is formed in the grain boundaries, Ga concentration in the main phase grains does not change. On the other hand, during the cooling process which is after the heat treatment, part having low Ga concentration form at the outer peripheral part of the main phase grain. Therefore, when the $R_6T_{13}Ga$ phase uniformly form in the entire grain boundaries, Ga concentration at the outer peripheral part of the main phase grain tends to be lower than Ga concentration at the inside of the main phase grain. Therefore, when the $R_6T_{13}Ga$ phase is formed, particularly HcJ at room temperature tends to improve.

Specifically, the heat treatment may be performed within the range of 480° C. to 900° C. Also, the heat treatment may be carried out in one-step or in two-steps. In case of carrying out in one-step, the heat treatment may be carried out between the temperature range of 480° C. to 550° C. for 1 hour to 3 hours. In case of carrying out the heat treatment in two-steps, a heat treatment at 700° C. to 900° C. may be carried out for 1 hour to 2 hours, then a heat treatment at 480° C. to 550° C. may be carried out for 1 hour to 3 hours. Further, a fine structure changes depending on a temperature decreasing rate during the temperature decreasing process of the heat treatment, and the temperature decreasing rate may be 50° C./min or more, particularly 100° C./min or more, 250° C./min or less, and particularly 200° C./min or less. By regulating the raw material composition, the temperature decreasing rate during solidification of the preparation step, the above-mentioned sintering conditions and heat treatment conditions, and the like; [Ga]/[R], the presence of the $R_6T_{13}Ga$ phase, and the like can be controlled accordingly.

In the present embodiment, an example of the method of regulating [Ga]/[R], the presence of the $R_6T_{13}Ga$ phase, and the like in the main phase grains by the heat treatment conditions is described. However the method of producing the R-T-B based permanent magnet according to the present embodiment is not limited thereto. Even if a heat treatment and the like different from the present embodiment are performed, an R-T-B based permanent magnet exhibiting the same effects as described in the present embodiment may be obtained. This is attained by regulating a composition, a solidification condition during the preparation step, and a sintering condition.

The obtained R-T-B based permanent magnet may be machined into a desired shape if necessary (machining step). For example, a shape machining such as cutting and grinding, a chamfering such as barrel polishing, and the like may be carried out.

The heavy rare earth elements may be further diffused to the grain boundaries of the machined R-T-B based permanent magnet (grain boundary diffusion step). A method of grain boundary diffusion is not particularly limited. For example, a compound including the heavy rare earth elements may be adhered on the surface of the R-T-B based permanent magnet by coating, deposition, and the like, and then the heat treatment may be carried out, thereby the grain boundary diffusion may be performed. Also, the R-T-B based permanent magnet may be heat treated in the atmosphere including vapor of heavy rare earth elements, thereby the grain boundary diffusion may be performed. The R-T-B based permanent magnet can further enhance HcJ by performing the grain boundary diffusion.

The R-T-B based permanent magnet obtained by the above-mentioned steps may be further performed with a surface treatment such as a plating treatment, a resin coating treatment, an oxidizing treatment, a chemical treatment, and the like (surface treatment step). Thereby, the corrosion resistance can be further enhanced.

The R-T-B based permanent magnet according to the present embodiment is obtained by the above method, however, the method of producing the R-T-B based permanent magnet according to the present invention is not limited to the above method, and it may be modified accordingly. For example, in the present embodiment, the machining step, the grain boundary diffusion step, and the surface treatment step are performed, however, these steps do not necessarily have to be performed. Also, the use of the R-T-B based permanent magnet according to the present embodiment is not particularly limited. For example, it may be suitably used as a voice coil motor for a hard disk drive, an industrial machinery motor, and a home appliance motor. Further, it may be suitably used for an automobile component, particularly for EV component, HEV component, and FCV component.

Note that, the present invention is not limited to the above described embodiment and can be variously modified within the scope of the present invention.

The R-T-B based permanent magnet according to the present embodiment is not limited to the magnet produced by sintering. For example, the R-T-B based permanent magnet according to the present embodiment may be produced by hot working. A method for producing the R-T-B based permanent magnet by hot working includes the following steps:

(a) a melting and quenching step of melting raw material metals and quenching the resulting molten metal to obtain a ribbon;

(b) a pulverization step of pulverizing the ribbon to obtain a flake-like raw material powder;

(c) a cold forming step of cold-forming the pulverized raw material powder;

(d) a preheating step of preheating the cold-formed body;

(e) a hot forming step of hot-forming the preheated cold-formed body;

(f) a hot plastic deforming step of plastically deforming the hot-formed body into a predetermined shape; and (g) an aging treatment step of aging an R-T-B based permanent magnet.

Examples

Next, the present invention is described in further detail based on specific examples, however, the present invention is not limited to below examples. The below examples include a sintering step of sintering a green compact to obtain a sintered body, and a heat treatment step performing an aging treatment to the sintered body.

<Preparation Step>

First, raw material metals for a sintered magnet were prepared, and a raw material alloy was produced using the raw material metals by a strip casting method. For Examples 1 to 4 and Comparative examples 1 and 2, the raw material alloy having a composition shown in Table 2 was produced by a strip casting method under a condition shown in Table 1.

TABLE 1

| | Strip casting method condition | | | | | Sintering condition | | | |
|---|---|---|---|---|---|---|---|---|---|
| | | First cooling | Collecting box water | Collecting box water | Alloy | Sintering | Sintering | Mangetic properties | |
| | Alloy composition | rate (° C./sec) | temp. (° C.) | amount (L/min) | thickness (mm) | temp. (° C.) | time (h) | Br (mT) | HcJ (kA/m) |
| Example 1 | Composition 1 | 2500 | 5 | 50 | 0.22 | 980 | 12 | 1380 | 1687 |
| Example 2 | Composition 1 | 2500 | 5 | 50 | 0.22 | 1050 | 4 | 1378 | 1655 |
| Example 3 | Composition 2 | 2500 | 5 | 50 | 0.25 | 980 | 12 | 1382 | 1685 |
| Example 4 | Composition 3 | 2500 | 5 | 50 | 0.20 | 980 | 12 | 1376 | 1692 |
| Comparative example 1 | Composition 1 | 2500 | 30 | 20 | 0.23 | 980 | 12 | 1375 | 1504 |
| Comparative example 2 | Composition 1 | 1800 | 5 | 50 | 0.31 | 980 | 12 | 1372 | 1472 |

TABLE 2

| | Alloy composition (mass %) | | | | | | | | |
|---|---|---|---|---|---|---|---|---|---|
| | Nd | Pr | Co | B | Cu | Al | Ga | Zr | Fe |
| Composition 1 | 24.8 | 6.2 | 0.40 | 0.90 | 0.65 | 0.25 | 0.85 | 0.20 | bal. |
| composition 2 | 24.8 | 6.2 | 0.40 | 0.90 | 0.65 | 0.25 | 0.55 | 0.20 | bal. |
| Composition 3 | 24.8 | 6.2 | 0.40 | 0.80 | 0.65 | 0.25 | 0.85 | 0.20 | bal. |

A water temperature and a water amount of a collecting box shown in Table 1 indicate the water temperature and the water amount of a coolant flowing inside the collecting box. That is, these are parameters closely relating to a second cooling rate. The alloy thickness of Table 1 was an average value which is obtained by selecting arbitrary 50 alloy pieces from the produced raw material alloys, then measuring thickness of each alloy piece by a micrometer, then calculating an average value. In Comparative example 2, a first cooling rate was made slow, that is, a cooling rate when solidifying alloy pieces were made slow, thereby the alloy thickness was made thicker than other Examples and Comparative examples.

The content of each element shown in Table 2 was measured using X-ray fluorescence analysis for Nd, Pr, Fe, Co, Cu, Al, Ga, and Zr; and ICP emission spectroscopy was used for measuring B.

<Pulverization Step>

Next, hydrogen was stored into the raw material alloy, then a hydrogen pulverization treatment was performed which carried out dehydrogenation for 2 hours at 300° C. under Ar gas atmosphere. Then, the obtained pulverized product was cooled to room temperature under Ar gas atmosphere.

After adding and mixing a pulverization aid to the obtained pulverized product, a fine pulverization was carried out using a jet mill, thereby a raw material powder having an average particle size of 3 μm was obtained.

<Compacting Step>

The obtained raw material powder was compacted under low oxygen atmosphere (atmosphere having oxygen concentration of 100 ppm or less), in a condition of a magnetic field of 1200 kA/m and a pressure of 120 MPa, thereby a green compact was obtained.

<Sintering Step>

Then, the green compact was sintered under a vacuum atmosphere at a sintering temperature and for a sintering time shown in Table 1, then it was quenched; thereby a sintered body was obtained.

<Heat Treatment Step>

The obtained sintered body was carried out with a two-step heat treatment under Ar gas atmosphere. A heat treatment of first-step was maintained at 880° C. for 60 minutes then pressure was increased to 5 kPa and cooled to room temperature. A heat treatment of second-step was maintained at 500° C. for 90 minutes then pressure was increased to 5 kPa then cooled to room temperature.

Each sample obtained as mentioned in above (Examples 1 to 4 and Comparative examples 1 and 2) was measured with the magnetic properties. Specifically, a B-H tracer was used to measure Br and HcJ. The results are shown in Table 1.

Next, each sample measured with the magnetic properties was cut and a cross section was polished. Then, an element distribution of the polished cross section was analyzed using SEM (SU-5000 made by Hitachi High-Technologies Corporation) and EDS (EMAX Evolution made by HORIBA, Ltd). The measurement was carried out at a magnification of 5000×. Then, three main phase grains having a long diameter of 4 μm or longer were selected from the obtained SEM image. Then, using EDS, electron beam having a spot diameter of 2 μm was irradiated to a measurement point which was set to an approximate center part of each of the main phase grains, thereby a concentration of each element was measured. From the concentration of each element in each measurement point, [Ga]/[R] of each measurement point was calculated, and [Ga]/[R] of the main phase grain having each measurement point was determined. Results are shown in Table 3 and 4.

TABLE 3

| | | Example 1 | | | Example 2 | | |
|---|---|---|---|---|---|---|---|
| | | Measurement point 1 | Measurement point 2 | Measurement point 3 | Measurement point 1 | Measurement point 2 | Measurement point 3 |
| Content (atom %) | Ga | 0.35 | 0.56 | 0.29 | 0.44 | 0.32 | 0.33 |
| | Pr | 1.80 | 1.86 | 1.70 | 1.78 | 1.66 | 1.79 |
| | Nd | 7.59 | 7.92 | 8.02 | 7.89 | 8.11 | 7.62 |
| [Ga]/[R] | | 0.038 | 0.057 | 0.030 | 0.046 | 0.033 | 0.035 |

| | | Example 3 | | | Example 4 | | |
|---|---|---|---|---|---|---|---|
| | | Measurement point 1 | Measurement point 2 | Measurement point 3 | Measurement point 1 | Measurement point 2 | Measurement point 3 |
| Content (atom %) | Ga | 0.42 | 0.36 | 0.29 | 0.46 | 0.48 | 0.52 |
| | Pr | 1.78 | 1.82 | 1.81 | 1.86 | 1.83 | 1.83 |
| | Nd | 7.60 | 7.90 | 7.66 | 8.01 | 8.02 | 7.98 |
| [Ga]/[R] | | 0.045 | 0.037 | 0.031 | 0.047 | 0.049 | 0.053 |

TABLE 4

| | | Comparative example 1 | | | Comparative example 2 | | |
|---|---|---|---|---|---|---|---|
| | | Measurement point 1 | Measurement point 2 | Measurement point 3 | Measurement point 1 | Measurement point 2 | Measurement point 3 |
| Content (atom %) | Ga | 0.21 | 0.07 | 0.15 | 0.18 | 0.13 | 0.09 |
| | Pr | 1.92 | 1.71 | 1.80 | 1.75 | 1.72 | 1.78 |
| | Nd | 7.94 | 8.00 | 7.60 | 7.86 | 8.03 | 7.85 |
| [Ga]/[R] | | 0.021 | 0.007 | 0.016 | 0.019 | 0.013 | 0.009 |

Further, element mapping was performed to the cross section using SEM and EDS at a magnification of 2500×. Thereby, it was verified whether an $R_6T_{13}Ga$ phase was included in the grain boundaries. Regarding Examples 1 to 4 and Comparative examples 1 and 2, all of the samples were verified to have the $R_6T_{13}Ga$ phase in the grain boundaries.

Example 1 and Example 2 are compared. Example 1 in which sintering was performed at 980° C. had a higher [Ga]/[R] and better HcJ compared to Example 2 in which sintering was performed at 1050° C. Example 1 performed sintering at a relatively low temperature, thus a small amount of the main phase dissolved during sintering, thus it is thought that Ga which solid dissolved to the main phase grains during the production of the raw material alloy scarcely diffused into the grain boundaries during sintering.

Example 1, Example 3, and Example 4 are compared. Example 3 had the composition with low Ga compared to Example 1, and Example 4 had the composition with low B compared to Example 1. However, both Examples 3 and 4 had Ga content and B content which were within the range of the above-mentioned composition, and both Examples 3 and 4 exhibited about the same magnetic properties.

Example 1 and Comparative example 1 are compared. Comparative example 1 had a higher water temperature of collecting box and a lower water amount of collecting box compared to Example 1. That is, Comparative example 1 had a slower second cooling rate compared to Example 1. As a result, in Comparative example 1, Ga scarcely solid dissolved in the main phase grains during the production of the raw material alloy, thus [Ga]/[R] decreased significantly. Further, in Comparative example 1, the magnetic properties, particularly HcJ decreased significantly.

Example 1 and Comparative example 2 are compared. Comparative example 2 had a slower first cooling rate compared to Example 1 and the alloy was thicker. Since the alloy thickness of Comparative example 2 was thicker, a second cooling rate is slower compared to Example 1. As a result, in Comparative example 2, Ga scarcely solid dissolved in the main phase grains during the production of the raw material alloy, thus [Ga]/[R] decreased significantly. Further, in Comparative example 2, the magnetic properties, particularly HcJ decreased significantly.

NUMERICAL REFERENCES

1 . . . Main phase grain
11 . . . Long diameter
11A . . . Center (of main phase grain)

What is claimed is:

1. An R-T-B based permanent magnet comprising Ga, wherein R is one or more rare earth elements, T is Fe or a combination of Fe and Co, and B is boron, the R-T-B based permanent magnet comprises main phase grains including a crystal grain having an $R_2T_{14}B$ crystal structure and grain boundaries formed between adjacent two or more main phase grains, and $0.030 \leq [Ga]/[R] \leq 0.100$ is satisfied in which [Ga] represents an atomic concentration of Ga and [R] represents an atomic concentration of R in the main phase grains.

2. The R-T-B based permanent magnet according to claim 1, wherein the grain boundaries include an $R_6T_{13}Ga$ phase.

3. The R-T-B based permanent magnet according to claim 1, wherein an average grain size of the main phase grains is 1 μm or more to 30 μm or less.

4. The R-T-B based permanent magnet according to claim 1, wherein 70% or more of the main phase grains in number base satisfy $0.030 \leq [Ga]/[R] \leq 0.100$.

5. The R-T-B based permanent magnet according to claim 1, wherein Ga concentration in a main phase grain is 0.5 atom % or more.

6. The R-T-B based permanent magnet according to claim 1, wherein an approximate center part of a main phase grain has a relatively high Ga concentration and an outer peripheral part of the main phase grain has a relatively low Ga concentration.

7. The R-T-B based permanent magnet according to claim 1, wherein an approximate center part of a main phase grain has a relatively high B concentration and an outer peripheral part of the main phase grain has a relatively low B concentration.

8. The R-T-B based permanent magnet according to claim 1, wherein an approximate center part of a main phase grain has a relatively high C concentration and an outer peripheral part of the main phase grain has a relatively low C concentration.

9. The R-T-B based permanent magnet according to claim 1, wherein the grain boundaries include an R-rich phase.

* * * * *